US010655442B2

(12) United States Patent
Lecerf et al.

(10) Patent No.: US 10,655,442 B2
(45) Date of Patent: May 19, 2020

(54) METHOD FOR WELLBORE STIMULATION OPTIMIZATION

(71) Applicant: Schlumberger Technology Corporation, Sugar Land, TX (US)

(72) Inventors: Bruno Lecerf, Houston, TX (US); Pierre Ramondenc, Sugar Land, TX (US); Philippe Michel Jacques Tardy, Hellerup (DK)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/729,454

(22) Filed: Dec. 28, 2012

(65) Prior Publication Data

US 2014/0182841 A1 Jul. 3, 2014

(51) Int. Cl.
*E21B 43/25* (2006.01)
*E21B 43/26* (2006.01)

(52) U.S. Cl.
CPC ..... *E21B 43/25* (2013.01); *E21B 43/26* (2013.01)

(58) Field of Classification Search
CPC ..... E21B 43/25; E21B 43/26
USPC ..... 166/308.1, 250.1
See application file for complete search history.

(56) References Cited

U.S. PATENT DOCUMENTS 6,196,318 B1 3/2001 Gong et al.
7,603,261 B2 10/2009 Tardy
2003/0050758 A1 3/2003 Soliman et al.
2005/0061509 A1* 3/2005 Nguyen ..... 166/307
2007/0240880 A1* 10/2007 Olsen ..... E21B 43/006 166/259
2008/0015832 A1 1/2008 Tardy
2008/0164021 A1* 7/2008 Dykstra ..... 166/250.1
2008/0183451 A1 7/2008 Weng et al.
(Continued)

FOREIGN PATENT DOCUMENTS

RU 2188934 C2 9/2002
RU 2382186 C1 2/2010

OTHER PUBLICATIONS

Economides, et al., "Reservoir Stimulation, 3d Edition", Wiley & Sons Ltd., 2000, Chapters 19 and 20.
(Continued)

*Primary Examiner* — Brad Harcourt
(74) *Attorney, Agent, or Firm* — Cathy Hewitt

(57) ABSTRACT

Methods of performing a stimulation operation at a wellsite are disclosed. The wellsite is positioned about a subterranean formation having a wellbore therethrough and zones thereabout. The method involves establishing at least one objective for stimulating production of reservoir fluid from the subterranean formation and into the wellbore. The stimulating involves placing a stimulating fluid along the zones of the wellbore. The objective is based on wellsite data. The method also involves identifying at least one constraint for the stimulating, determining target distributions of the stimulation fluid based on the objective(s) and the constraint(s), and selecting operational parameters for the stimulating based on the constraint(s) and the target distributions. The method may also involve stimulating the subterranean formation using the target distributions and the operational parameters, monitoring the wellsite during the stimulating, and adjusting the stimulating based on the monitoring.

23 Claims, 11 Drawing Sheets

(56) References Cited

U.S. PATENT DOCUMENTS

| | | | | |
|---|---|---|---|---|
| 2008/0209997 | A1 | 9/2008 | Bailey et al. | |
| 2010/0006292 | A1 | 1/2010 | Boles et al. | |
| 2010/0252268 | A1* | 10/2010 | Gu et al. | 166/308.1 |
| 2012/0179444 | A1* | 7/2012 | Ganguly et al. | 703/10 |
| 2012/0181031 | A1* | 7/2012 | Le | E21B 37/10 166/308.1 |
| 2013/0158959 | A1* | 6/2013 | Gu | E21B 43/26 703/2 |

OTHER PUBLICATIONS

Office Action issued in Kazakhstan Patent Appl. No. 2015/0884.1 dated Nov. 4, 2016; 8 pages (with English translation).
Decision on Grant issued in Kazakhstan Patent Appl. No. 2015/0884.1 dated Nov. 21, 2017; 10 pages.
Examination Report issued in GCC Patent Appl. No. GC 2013-26173 dated May 16, 2018; 4 pages.
Examination Report issued in GCC Patent Appl. No. GC 2013-26173 dated Oct. 14, 2018; 4 pages.

* cited by examiner 121
123
126

129
131
127
149
100
135
143
120
120
141
139
115
108
125
110.1
104
102
110.2
109
107
110.3
112
125
116
106
142
114
110.4
110.5

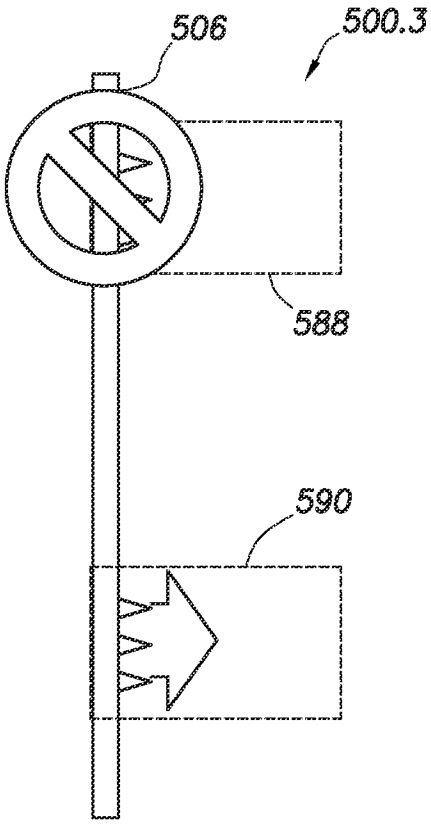
FIG.5.3
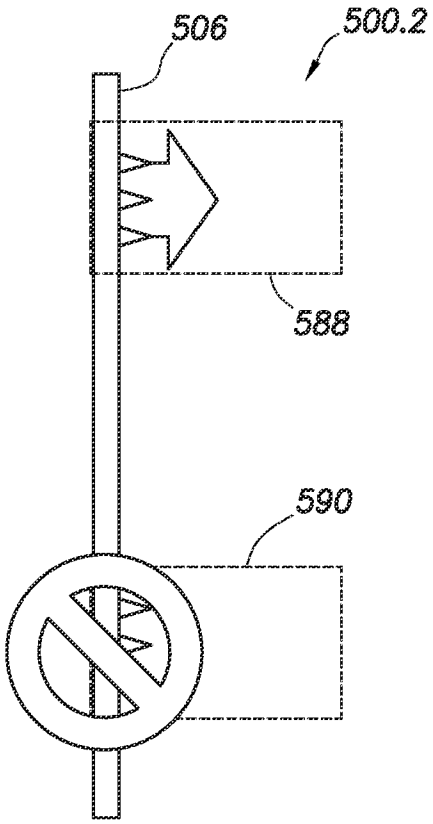
FIG.5.2
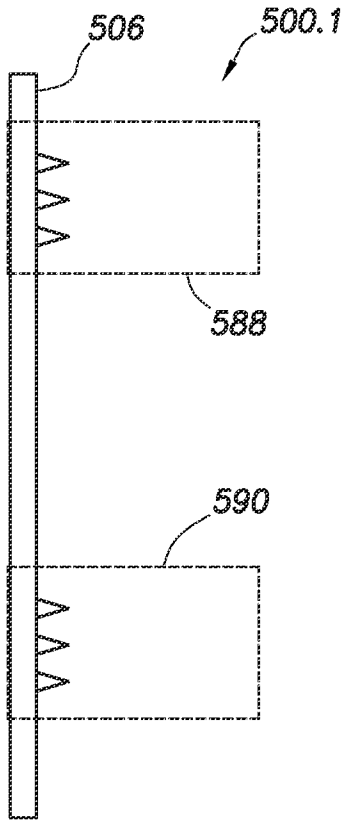
FIG.5.1

FIG.7
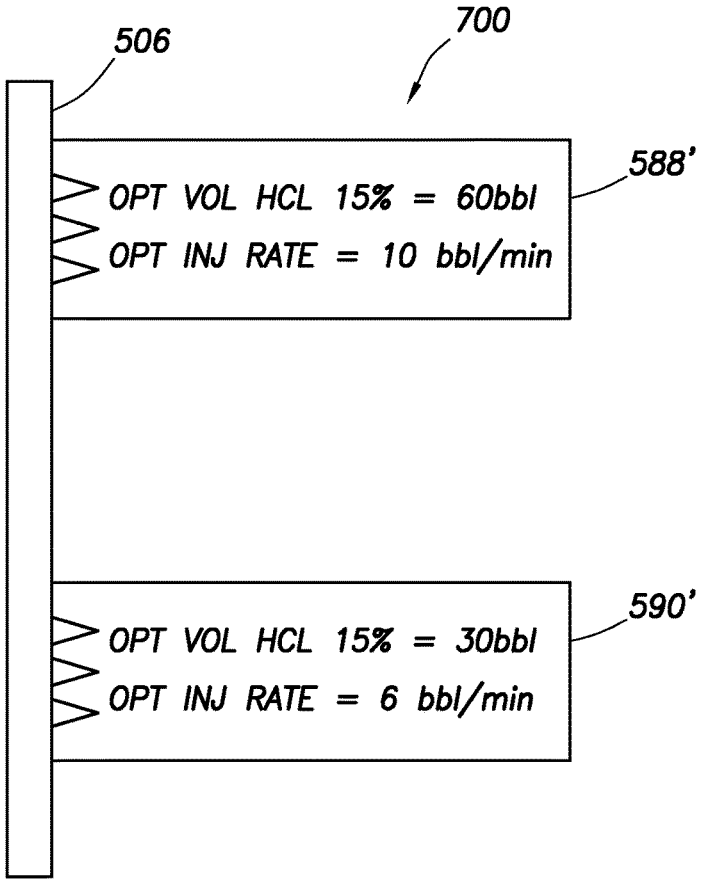
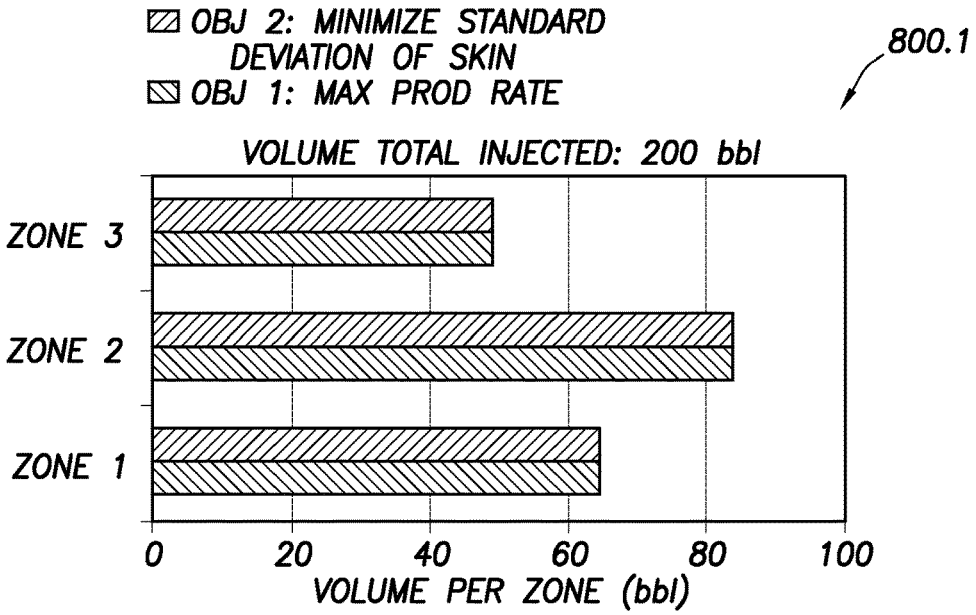
FIG.8.1

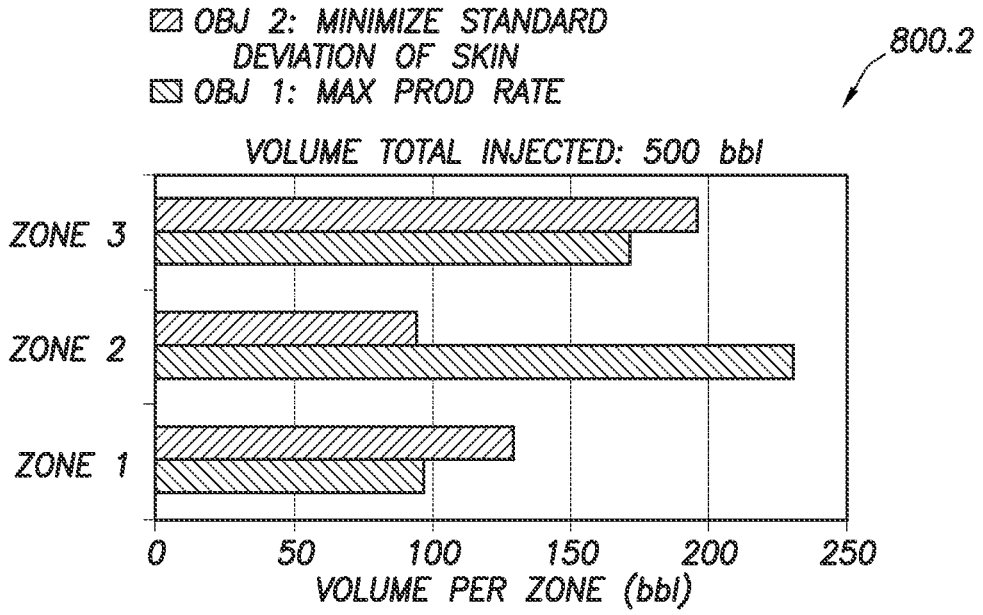
FIG.8.2
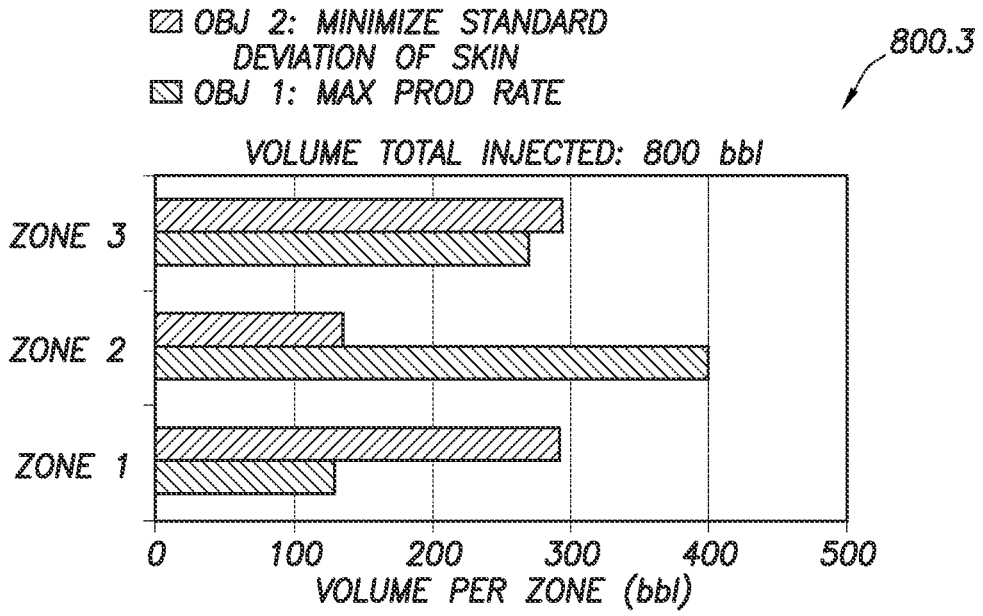
FIG.8.3

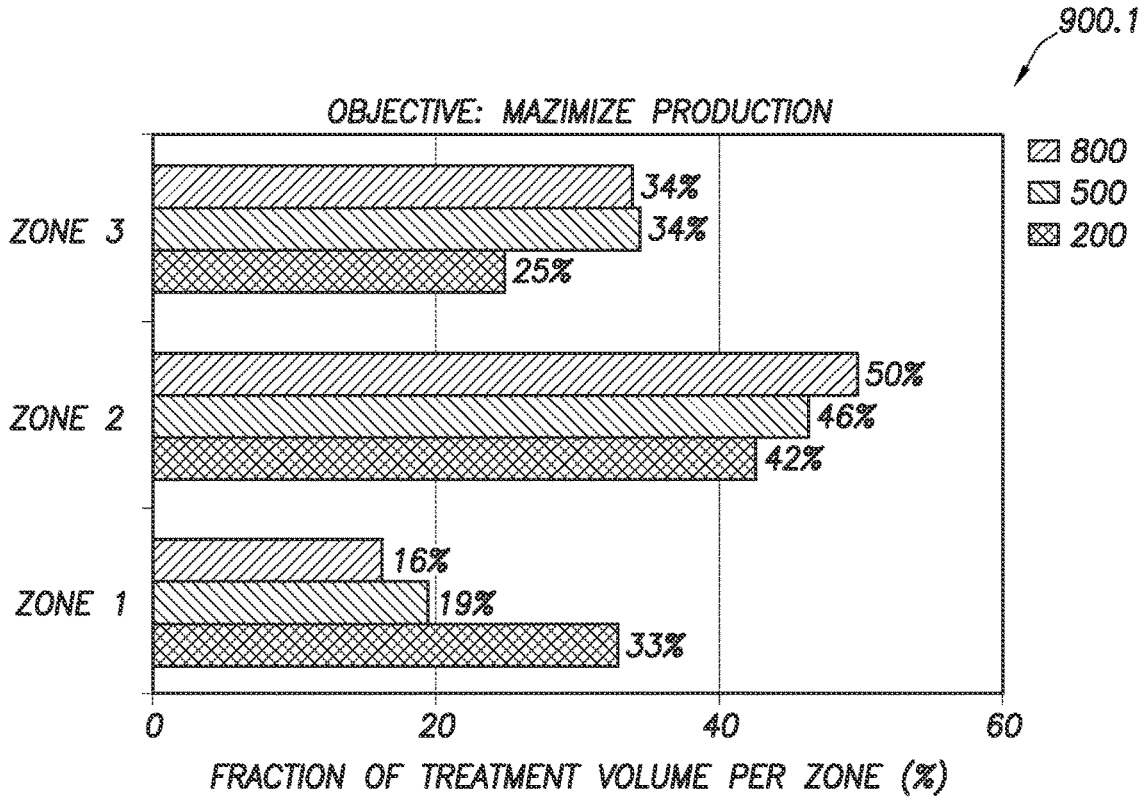
FIG.9.1
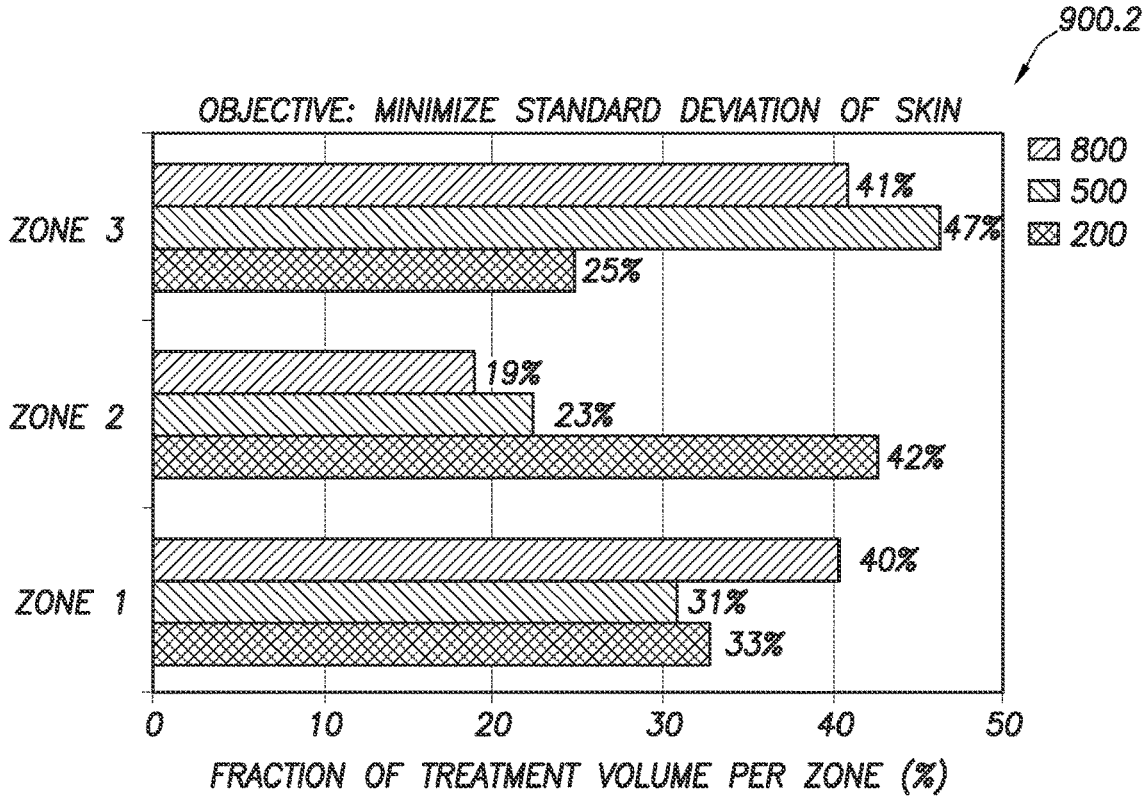
FIG.9.2

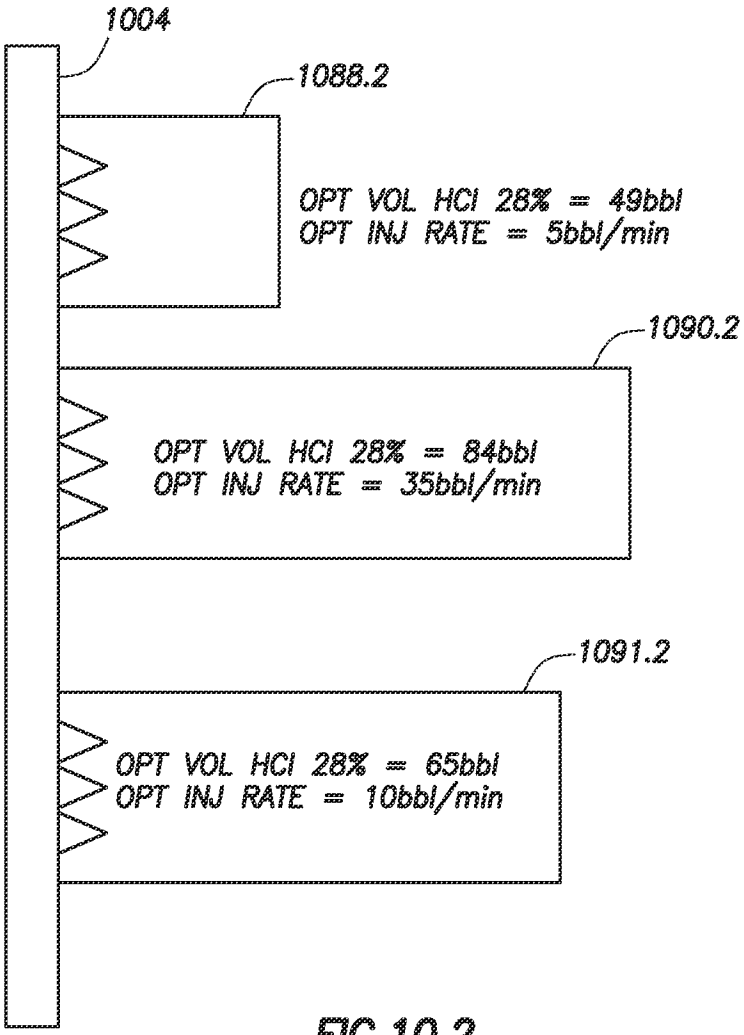
FIG.10.2
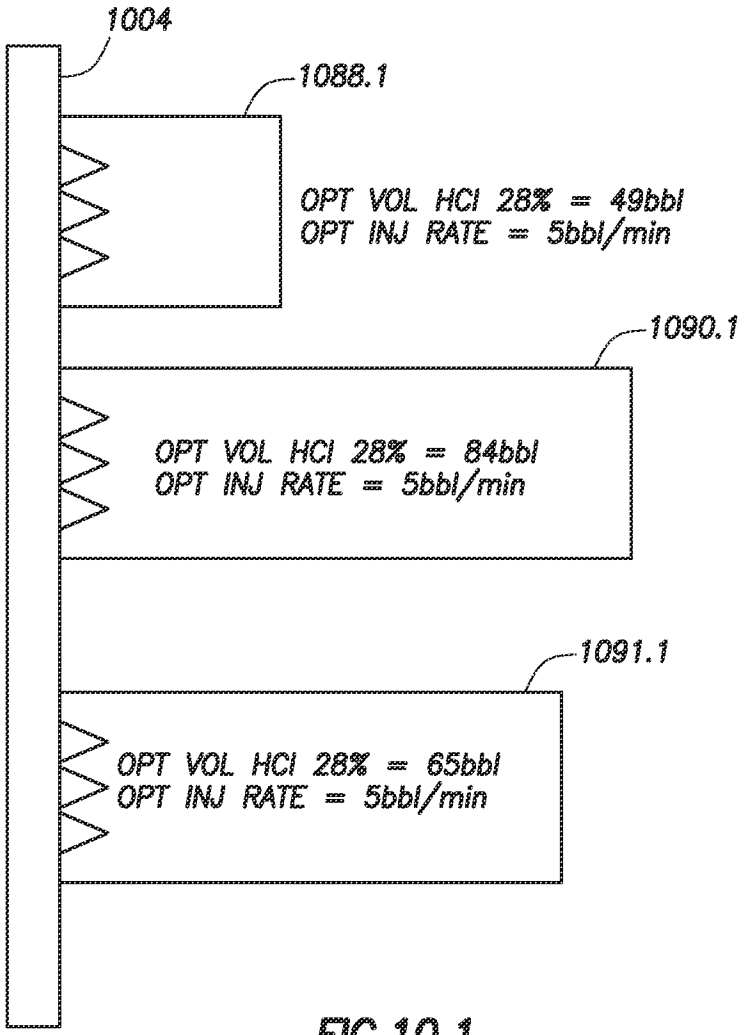
FIG.10.1

METHOD FOR WELLBORE STIMULATION OPTIMIZATION

BACKGROUND

The present disclosure relates generally to methods and systems for performing wellsite operations. More particularly, this disclosure is directed to methods and systems for performing stimulation operations along a wellbore.

Wellbore operations are performed to produce various fluids, such as hydrocarbons, from subsurface formations. To facilitate the production of such fluids from reservoirs within the formations, stimulation operations may be performed. Stimulation operations may involve acid treatments, such as matrix acidizing or hydraulic fracturing. Matrix acidizing may involve pumping an acid into an oil or gas-producing well to remove some of the formation damage along a wall of the wellbore caused by the drilling and completion fluids and drill bits during the drilling and completion process. Hydraulic fracturing may involve injecting fluids into the formation to create fractures that define larger pathways for fluid to pass from subsurface reservoirs and into the wellbore.

In some cases, it may be desirable to predict the outcome of a stimulation operation involving acid treatments. Examples of stimulation techniques involving acids are provided in U.S. Pat. No. 7,603,261. It may also be desirable to evaluate various aspects of the stimulation operation. Techniques for fluid placement and pumping strategy, and matrix stimulation treatment evaluation are provided in *Economides and Nolte, RESERVOIR STIMULATION,* 3*d Edition*, Wiley & Sons Ltd. (2000), Chapters 19 and 20 (hereafter "*RESERVOIR STIMULATION*"), the entire contents of which is hereby incorporated by reference herein.

SUMMARY

In at least one aspect, the present disclosure relates to a method of performing a stimulation operation at a wellsite. The wellsite is positioned about a subterranean formation having a wellbore therethrough and zones therealong. The method involves establishing at least one objective for stimulating production of reservoir fluid from the subterranean formation and into the wellbore. The stimulating involves placing a stimulating fluid along the zones of the wellbore. The objective is based on wellsite data. The method also involves identifying at least one constraint for the stimulating, determining target distributions of the stimulation fluid based on the objective(s) and the constraint(s), and selecting operational parameters for the stimulating based on the constraint(s) and the target distributions. The method may also involve collecting wellsite data, stimulating the subterranean formation using the target distributions and the operational parameters, monitoring the wellsite during the stimulating, and/or adjusting the stimulating based on the monitoring.

BRIEF DESCRIPTION OF THE DRAWINGS

Embodiments of methods for performing stimulation optimization are described with reference to the following figures. The same, or similar, numbers may be used throughout the figures to reference like features and components.

FIGS. 5.1-5.3 are schematic diagrams illustrating zones of a wellbore during injection;

FIG. 7 is a schematic diagrams illustrating optimized injection for two zones of a wellbore;

FIGS. 8.1-8.3 are graphs depicting volume injected across zones based on given objectives;

FIGS. 9.1-9.2 are graphs depicting volume injected across zones with an objective to maximize production and another to minimize standard deviation of skin, respectively;

FIGS. 10.1-10.2 are schematic diagrams illustrating optimized injection for three zones of a wellbore having the same and different injection rates, respectively.

DETAILED DESCRIPTION

The description that follows includes exemplary apparatuses, methods, techniques, and instruction sequences that embody techniques of the inventive subject matter. However, it is understood that the described embodiments may be practiced without these specific details.

Wellbore stimulation fluids (e.g., acids) are selectively placed downhole during stimulation operations (or treatment) to facilitate the production of fluids from subsurface reservoirs. Stimulation operations may involve, for example, matrix acidization, injection, fracturing, etc. The stimulation fluids may be placed in select zones along the wellbore based on an understanding of operational objectives, such as maximum production rate, maximum fluid recovery, uniform placement of fluids across zones, and/or other objectives, for performing the stimulation operation. The stimulation fluids may also be applied using various stimulation parameters, such as flow rates, concentrations, composition, etc. Other considerations may be taken into account, such as the skin surrounding the wellbore and/or other wellsite parameters.

As used herein, 'skin' refers to a dimensionless number that describes the amount of damage that the portion of the formation surrounding the wellbore underwent during drilling (or other operations) of the wellbore. In some cases, damage along the wellbore may result in a reduction in permeability due to, for example, blockage of perforations in the formation as earth is displaced during drilling and/or completion. Skin parameters may include skin effect, permeability due to skin damage, etc. "Placement" as used herein may refer to the position, composition, flow rate and/or other fluid parameters about one or more zones that may be adjusted when using stimulation fluids, such as acids.

Figure 1:
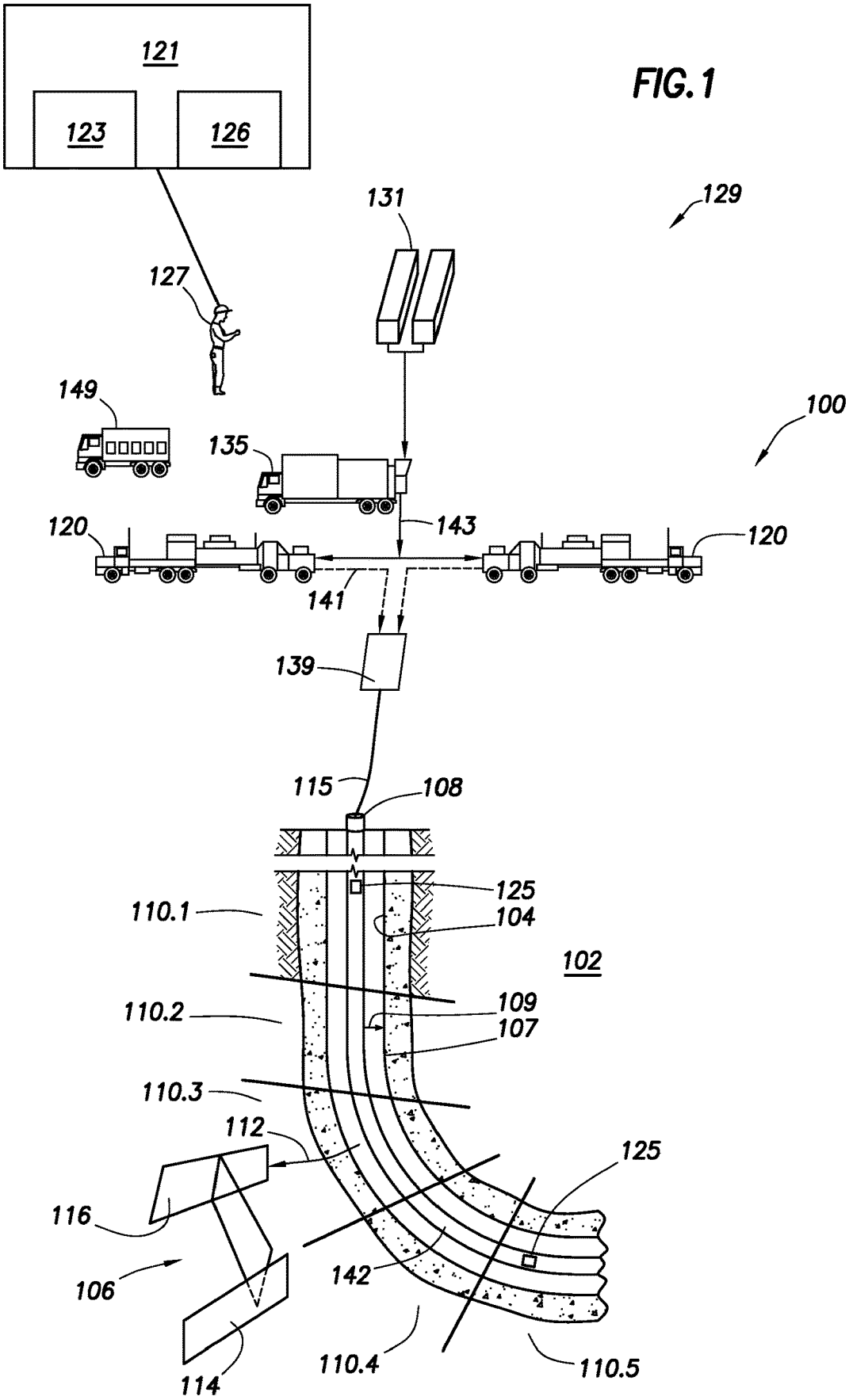
FIG. 1 is a schematic diagram illustrating a stimulation operation at a wellsite.

FIG. 1 depicts a stimulation operation at a wellsite 100. The wellsite 100 has a wellbore 104 extending from a wellhead 108 at a surface location and through a subterranean formation 102 therebelow. A pump system 129 is positioned about the wellhead 108 for passing stimulation fluid through tubing 142 and into the wellbore 104.

Various stimulation fluids may be deployed downhole to perform various stimulation operations. For example, acids (e.g., hydrochloric (HCl), hydrofluoric (HF), or acetic acid) may be applied to portions of the wall 107 of the wellbore 104 for matrix acidization as indicated by arrow 109. Acids may be disposed downhole along zones 110.1-110.5 located at various depths along the wellbore 104 as shown.

Devices, such as diverters, valves or other fluid control devices, may be positioned about the tubing 142 and may be used to selectively distribute the stimulation fluid passing through the tubing 142. The devices may also be used to focus the fluid into a desired area of the wellbore. For example, diverters may be chemical agents and/or mechanical device (e.g., ball diverter) used to provide uniform distribution of stimulation fluid across one or more of the zones 110.1-110.4.

Stimulation fluids, such as water, acid, polymer gel, etc., may also optionally be injected into the surrounding formation to fracture the formation surrounding the wellbore as indicated by arrow 112. The formation 102 may have a fracture network 106 including natural fractures 114 present before fracturing, as well as fracture planes 116 generated during the injection of the stimulation fluids. Stimulation fluids, such as acids, viscous gels, "slick water" (which may have a friction reducer (polymer) and water) may be used to hydraulically fracture the formation 102. Such "slick water" may be in the form of a thin fluid (e.g., nearly the same viscosity as water) and may be used to create more complex fractures, such as multiple micro-seismic fractures detectable by monitoring. Proppants, such as sand may then be injected to prop channels in the formations open for production of fluid therethrough.

Stimulation fluids may be deployed downhole using the pump system 129. The pump system 129 is depicted as being operated by a field operator 127 for recording maintenance and operational data and/or performing maintenance in accordance with a prescribed maintenance plan. In the example shown, the pump system 129 includes a plurality of tanks 131, which feed fluids to a blender 135 where it is mixed with a proppant to form a stimulation fluid. A gelling agent may be used to increase the viscosity of the stimulation fluid, and to allow the proppant to be suspended in the stimulation fluid. It may also act as a friction reducing agent to allow higher pump rates with less frictional pressure.

The stimulation fluid is then pumped from the blender 135 to the treatment trucks 120 with plunger pumps as shown by solid lines 143. Each treatment truck 120 receives the fracturing fluid at a low pressure and discharges it to a common manifold 139 (sometimes called a missile trailer or missile) at a high pressure as shown by dashed lines 141. The missile 139 then directs the stimulation fluid from the treatment trucks 120 to the wellbore 104 as shown by solid line 115.

One or more treatment trucks 120 may be used to supply stimulation fluid at a desired rate. Each treatment truck 120 may be normally operated at any rate, such as well under its maximum operating capacity. Operating the treatment trucks 120 under their operating capacity may allow for one to fail and the remaining to be run at a higher speed in order to make up for the absence of the failed pump.

A surface unit 121 with a stimulation tool 123 is provided to direct the entire pump system 129 during the stimulation operation. The surface unit 121 is schematically depicted as being linked to the operator 127, but may be manually or automatically linked to various portions of the wellsite and/or offsite locations as desired, such as mobile control station 149.

A stimulation tool 123 may be used to selectively provide the stimulation fluids. The stimulation tool 123 is schematically depicted as part of the surface unit 121, but could be at any location. The stimulation tool 123 may be used to communicate with the wellsite, for example, to receive data and/or to send commands. The stimulation tool 123 may determine distributions based on desired objectives using a distribution component, monitor in real time using a monitoring component and direct a controller 126 to adjust operations as needed. The stimulation tool 123 and the controller 126 may then be used to direct the flow of stimulation fluids onto the wellbore wall and/or into the formations along one or more of the zones 110.1-110.5 along the wellbore 104.

The stimulation fluids may also be controlled to manipulate the matrix acidization, fracturing process and/or other stimulation operations. For example, fluid types, pressures, placement, and other stimulation parameters may be manipulated to optimize the matrix acidization and/or fracturing. Depending upon desired objectives of the stimulation, the stimulation fluids may be placed and/or the stimulation operation performed as desired.

Sensors 125 may be provided about the wellsite 100 to measure various parameters, such as stimulation parameters (e.g., flow rates), wellsite parameters (e.g., downhole temperatures) and/or other parameters. Information gathered from the sensors 125 may be fed into to the stimulation tool 123. The stimulation tool 123 may be used to receive and process the information. The stimulation tool 123 may then be used to affect operational changes, such as adjusting the stimulation or other operations, at the wellsite 100 via the controller 126.

Figure 2:
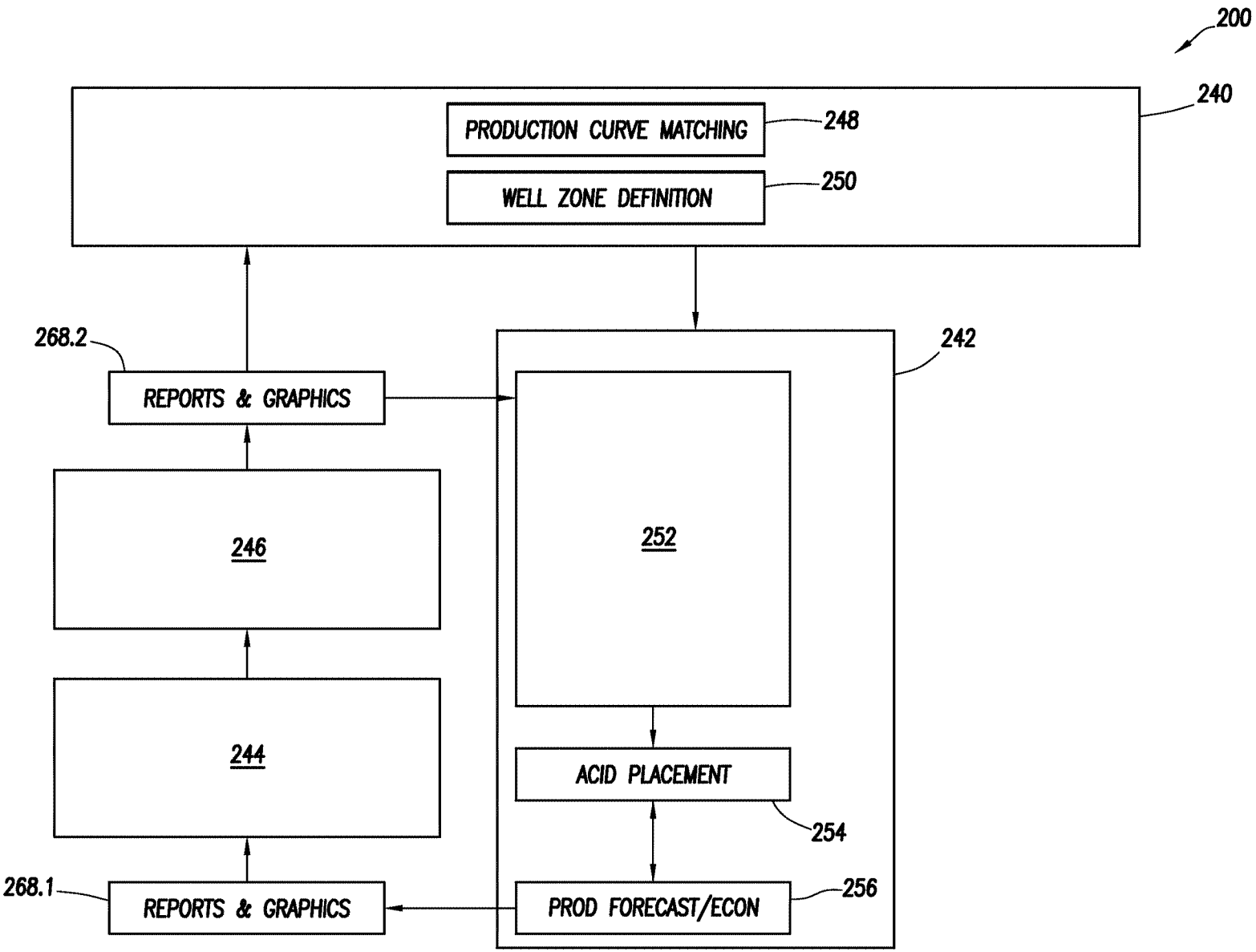
FIG. 2 is a schematic diagram illustrating a method of stimulating a wellbore using a "design-execute-evaluate" configuration.
Figure 3:
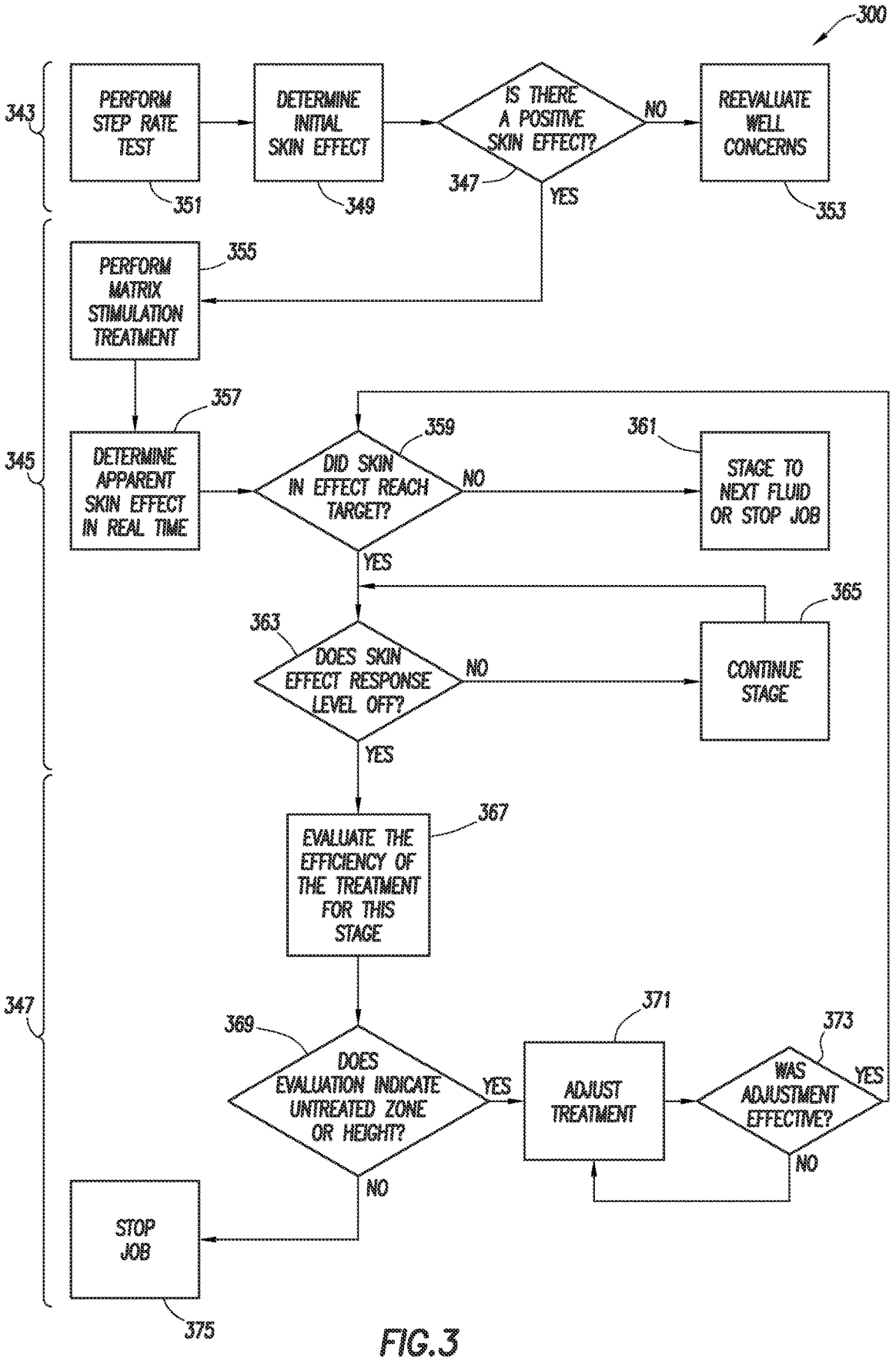
FIG. 3 is a schematic diagram illustrating a method of stimulating a wellbore using a "skin effect" configuration.
Figure 4:
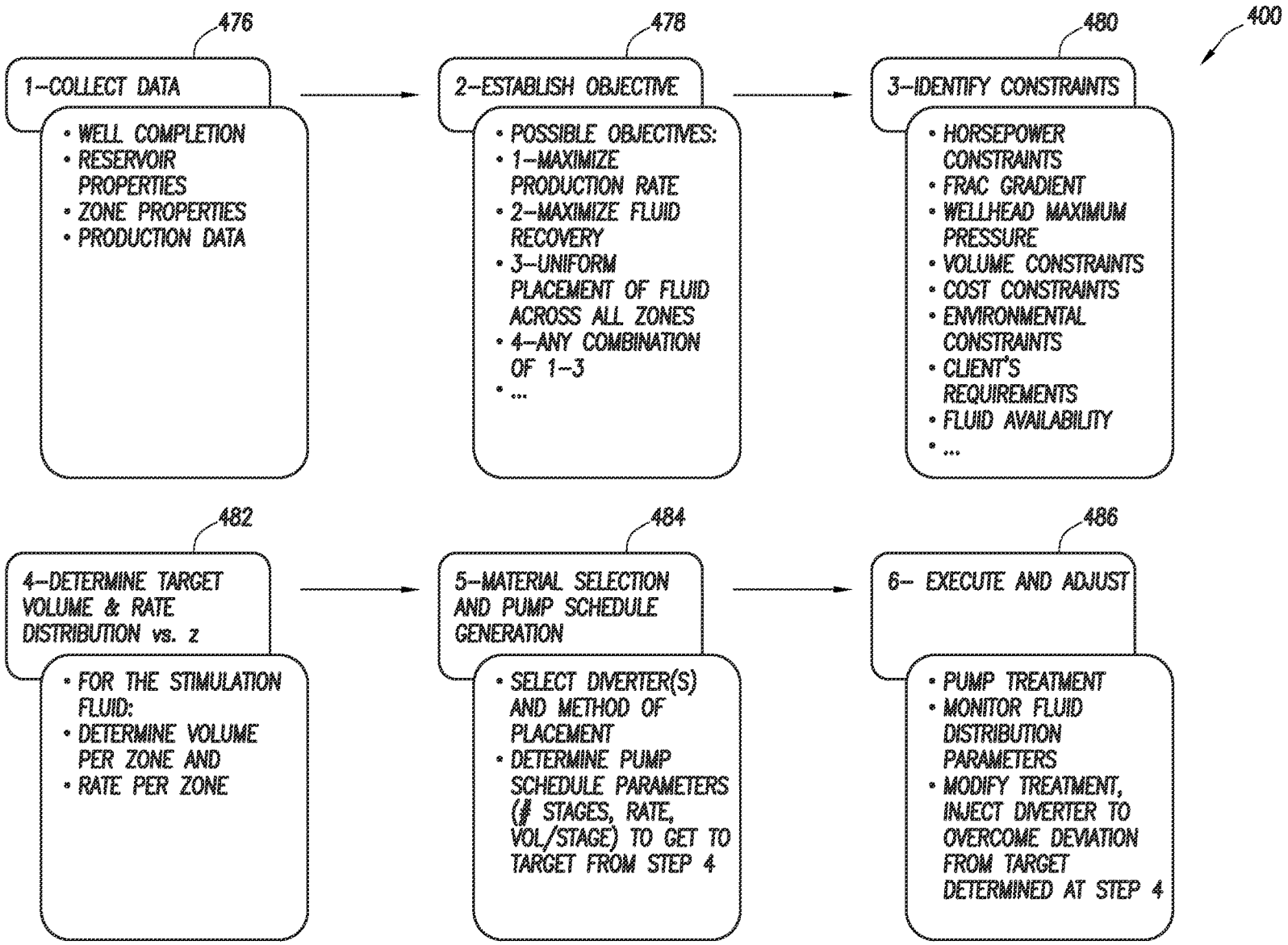
FIG. 4 is a schematic diagram illustrating a method of stimulating a wellbore using an "objective function" configuration.

The stimulation operation may be performed using various techniques, such as the "design-execute-evaluate" configuration of FIG. 2, the "skin effect" configuration of FIG. 3, and the "objective function" configuration of FIG. 4. While the various configurations are described separately, various aspects of the configurations may optionally be used and/or interchanged as desired. For example, the objective function configuration of FIG. 4 may optionally employ the skin effect configuration of FIG. 3. The selected configuration may be used to optimize the stimulation, production and/or other operations at the wellsite.

The methods associated with the various configurations provided herein may be performed, for example, by the stimulation tool 123 and/or surface unit 121 of FIG. 1. The methods may be performed iteratively as new data is received, for example, from sensors 125 at the wellsite 100 as the stimulation operation is implemented. The stimulation tool 123 may have various modules and/or simulators that may be used to perform simulations, such a placement simulator (e.g., as WELLBOOK, STIMCADE, ACTIVE, ACTIVE MATRIX, PROCADE, PIPESIM, etc. (commercially available from SCHLUMBERGER TECHNOLOGY CORPORATION at http://www.slb.com)).

The stimulation operation may be adjusted, for example by selectively providing placement of the acid, as information is received using, for example, the pumping operation of FIG. 1. The controller 126 may implement adjustments at the wellsite 100. The methods may be used to provide, for example, a pumping schedule defining pumping configurations for placement of stimulation fluid across one or more zones 110.1-110.5 during stimulation operations.

FIG. 2 shows an example method 200 of performing a stimulation operation involving matrix acidizing using a "design-execute-evaluate" configuration. The method 200 includes a wellbore phase 240, a design phase 242, an execution phase 244, and an evaluation phase 246. The wellbore phase 240 involves production curve matching 248 and well zone definition 250. The wellbore phase 240 may be performed using, for example, PROCADE, Analysis WELLBOOK: Production (AWP) to curve fit production estimates, and nodal analysis with a simulator, such as PIPESIM, to define the wellbore. Simulations may be performed, for example, to discretize the well in zones and to determine, for example, the optimal final skin distribution. These simulations may provide information that may be used, for example, in a fluid placement simulator and/or to design stimulation operations to achieve a final skin distribution along the wellbore.

The design phase 242 involves gathering design parameters 252, determining acid placement 254, and determining production forecast 256. The design parameters 252 may include, for example a candidate selection, a formation damage identification, a fluid selection, a pumping schedule generation, etc.

Various modules may be used to provide the design parameters 252, acid placement and other portions of the method 200. For example, a critical drawdown information module may be used to provide candidate selection, a scale predictor may be used to provide formation damage identification, a ball sealer may be used to provide the pumping schedule generator, etc. In another example, at least some information, such as the pumping schedule information for the pumping schedule generator, may be provided by an engineer.

Acid placement 254 is determined from the design parameters 252 and production forecast 256 is generated from the acid placement 254. The acid placement 254 and production forecast 256 may be iterated as indicated by the dual arrow. The results may be implemented at the wellsite in the execution phase 244 (e.g., using the operator 127 and/or the surface unit 121 of FIG. 1). During implementation, sensors (e.g., 125 of FIG. 1) may be used to provide information during the evaluation phase 246. New production forecasts may be generated and adjustments implemented. At various intervals or at desired times (e.g., upon completion of the design phase 242 or evaluation phase 246), outputs (e.g., reports, graphics) 268.1, 268.2 may be provided.

Various modules may be used to provide acid placement 254, production forecast 256, execution 244 and evaluation 246. For example, a placement module (e.g., GEOCHECK™) may be used to provide acid placement 254, an execution module (e.g., MATTIME and STEP RATE Migration) may be used in execution 244, and production modules (e.g., real time acid placement and production forecast/econ) may be used in evaluation.

The information provided in the method 200 may include global variables. The global variables may be used, for example, in the execution 244 and the evaluation 246 to provide a global target, or an overall solution for performing the stimulation operation. The method 200 may also optionally be performed using objective variables, which tailor the stimulation operation to achieve predefined objectives, such as which zones to stimulate and by how much. The resulting fluid schedule may be an optimum fluid schedule, or a solution generated so that a desired objective is achieved. For example, optimization may be generated based on the ability to generate a better stimulation of the well with the volume of the injected fluids, or the ability to distribute fluid differently across zones to optimize production or reach a production profile target.

The global variables may be provided without being discretized by zone, and may include, for example, target fluid invasion depth, target live acid invasion depth, target final damage skin, wellbore volume, etc. Target fluid invasion depth is the distance from the wellbore used for nonreactive preflush, overflush, and main fluids. Target live acid invasion depth is the distance from the wellbore used for reactive preflush fluids (e.g., HCl steps in sandstone formations). Target final damage skin may be defined for reactive main fluids and/or for scale-dissolving fluids (e.g., if there is scale damage). For example, HCl may be used for carbonate reservoirs and HF may be used for sandstones. Wellbore volume is internally calculated based on the input to a well completion window and may be used for displacement fluids and tubing spacers.

Fluid distribution along the zones may also be performed using acid placement simulations. Various parameters may be changed to achieve a desired configuration, such as a fluid distribution that will provide the target skin distribution. Correlations between fluid injection rate, fluid volume and skin reduction may be considered. The placement simulator may consider various zones in each simulation to determine how each change in the design may impact the fluid distribution in several zones. A placement simulator, such as WELLBOOK or STIMCADE may decouple various aspects of the stimulation operation from an overall solution to provide where and/or how to inject the stimulation fluid. The materials, diverter, placement and/or other stimulation parameters may be selected to achieve the optimal fluid distribution.

The "design-execute-evaluate" configuration involves designing treatments that are sensitive to information that may be gathered. For example, designing a treatment with an engineering design tool (such as STIMCADE) may involve characterization of the skin in each layer. Skin damage characteristics may be determined based on damage penetration using logging tools.

Stimulation may be optimized, for example, by performing sensitivity analysis on various wellsite parameters, such as damage properties, volumes, permeability, rate, skin, etc., and selecting the treatment that is most robust to such parameters. In other words, treatment may be selected based on the outcome that is the least sensitive to uncertainty while providing a result close enough to the optimum.

Adjustment may be performed during stimulation execution 246 based on real-time (RT) monitoring. For example, corrective actions may be taken while pumping based on measurements taken during the pumping. The RT monitoring may involve using a global parameter, such as skin (or wellbore damage along the wall of the wellbore generated during drilling). In another example, for multi-layered carbonate formations, the proper placement of the fluid across zones of different injectivity and different impact on the production may be monitored.

Adjustments may be taken during operations using, for example, a coiled tubing unit equipped with an optical fiber placed in the string to provide telemetry to the BHA. This equipment may be used to modify the original treatment design to target zones that show poor injectivity during a job. An example of coiled tubing includes ACTIVE™.

Corrective actions during treatment may also be taken with an optimal placement of the fluid in mind. Tools, such as coiled tubing equipment, may be used to identify zones which are not taking fluids, and corrective actions are taken to redirect fluids to these zones, but not to distribute the fluid along the well to reach the best treatment design.

Treatment design may decouple the questions of optimal placement of a fluid for a given well, the performance of the materials selected, and the treatment schedule considered.

A challenge for acidizing in multi-layered carbonate reservoirs may be to reach optimum placement of stimulation fluids. Optimum placement may be interpreted as uniform placement of the fluid across a producing interval. Optimum placement may also consider both the treatment's objective and its constraints. Carbonate acidizing treatment design may be supplemented to determine the optimum placement of fluid to reach an objective function.

FIG. 3 shows another example method 300 of performing a stimulation operation involving a "skin effect" configuration. This method 300 provides treatment diagnosis using real-time skin evolution. The method 300 involves initial skin evaluation 343, skin effect 345, and skin evaluation 347. Skin evaluation 343 involves determining 347 an initial skin effect 349 using a step rate test 351, and reevaluating well concerns 353 if no positive skin effect is present.

If a positive skin effect is present, then the skin effect 345 may be performed. The skin effect 345 involves performing matrix stimulation treatment 355 to determine apparent skin effect in real time 357. Whether skin effect is reached a target is then determined 359. If no, the job may be stopped or next fluid staged 361. If so, whether the skin effect response is leveling off may be determined 363. If no, the stage may be continued until leveling off occurs 365.

If the skin effect response levels off, the skin evaluation 347 may be performed. The skin evaluation 347 involves evaluating the efficiency of the treatment for the present stage 367 and determining if the evaluation indicates an untreated zone or height 369. If so, adjustments at the wellsite may be performed 371. If the adjustment is effective (e.g., there is an increase in concentration) 373, then the process may return to block 359. If not, the job may be stopped 375.

FIG. 3 is an example of a method that takes into consideration placement of stimulation fluids. Proper placement may be dependent, for example, on the zones encountered, the equipment used, etc. Ideal placement of stimulating fluid may involve a uniform placement, for example where all zones have similar injectivity. Ideal placement may vary, for example where multiple layered zones with different injectivities may be provided along the wellbore. Evaluations may be performed by comparing volumes required for a well with three zones of different properties to a case where all zones have same injectivity. Various diverters may be used in the wellbore, which may also be considered. These and other factors may be considered in determining the optimum placement. Examples of fluid placement are provided in *RESERVOIR STIMULATION*, previously incorporated by reference herein.

Stimulation may be adjusted in real time based on various downhole parameters, such as real-time skin evolution Skin evaluation may involve, for example, the Paccaloni technique, the Prouvost and Economides method, the Behema method, and/or other methods. Examples of pumping strategy and matrix treatment evaluation are provided in *RESERVOIR STIMULATION*, previously incorporated by reference herein.

Inverse injectivity diagnostics may be used to provide a real time estimation of the global and/or local skin distributions. The bottom-hole pressure (BHP) may be assumed to vary based on various factors, such as pumping rate, skin and other factors. These methods may determine, for example, whether a diverter has an effect on the injectivity of the well. These methods may also be used to refine a description of the diversion down to the zone level, to quantify flow distribution, and to determine if the target zones are actually the ones being acidized. Sensors may be provided to detect injection rates even in cases where the fluid is injected at rates that are very low, such as in large injectivity wells (long horizontal wells or wells in thick carbonate layers) where little pressure is generated when diverters are injected.

During operation, boxes 353, 361 and/or 375 may be continued or stopped during the injection. Other options may also be included, such as variation of the injection rate in carbonates. Various volumes of fluids may be used, as available. In some cases, fluid volumes may be limited (e.g., in offshore applications where stimulation fluids are pumped from a stimulation vessel, or where fluid volumes are limited by space and number of tanks on deck).

In some cases, the average skin effect may be isolated from BHP measurements and used as a diagnostic for optimizing treatment in a multi-layered reservoir. For example, an average skin evaluation may be used to determine whether the acid is removing a large fraction of the damage locally or uniformly along the whole treatment interval. In a multi-layered reservoir, placement may be a function of local damage removal.

In some cases, it may be assumed that there is a relationship between skin and BHP. In other cases, other factors may cause the BHP to vary while the skin remains constant. Such effects may include, for example, multiphase flow effects, viscosity contrast between injected and reservoir fluids, opening of fissures, etc.

While decisions may be based on a treatment objective that involves reaching uniform coverage of the entire well, the treatment objective of the stimulation may be characterized as seeking to achieve maximum production increase. In some cases, it may be more beneficial to inject all the acid into the most productive zones. These zones may contribute to production, and diverting acid into less productive zones may be detrimental to overall production. Highly productive zones may be capable of draining the other zones in a manner that may be equivalent to stimulating the lower productivity zones.

FIG. 4 shows an example method 400 of performing a stimulation operation involving matrix acidizing using an "objective function" configuration. This method involves designing and executing a matrix stimulation treatment, so that the treatment results in the optimum placement of the stimulating fluid, thus leading to optimum treatment of a well. Design parameters are configured to meet an objective function.

The method 400 involves collecting data 476, establishing objectives 478, identifying constraints 480, determining target distributions (e.g., volume and rate vs. z) 482, selecting operational parameters (e.g., material selection and pump schedule generation) 484, and executing 486. Data collection 476 may be performed using sensors at the wellsite (e.g., 125 of FIG. 1), data input from on or offsite personnel (e.g., an engineer), client input, historical data, etc. In a given example, an engineer may collect information on all the variables that can affect the placement of the fluid during the injection. Example data may include well completion and properties data (e.g., schematics, well perforations, wellbore deviation surveys), reservoir data (e.g., drainage radius, bottom-hole temperature, reservoir fluids property type or physical properties), damage type data (e.g., drilling, mud, scales), zonal property data and production data.

Zonal properties data may include, for example, information about zones top and bottom measured depths, permeability, porosity, far field pressure, rock characteristics (mineralogy/facies), presence of natural fractures, mechanical properties, logs with information by depth, etc. Zonal properties may provide discretization of parameters by zone. The values can be estimated from log measurements and correlated with experience in the reservoir. The presence of natural fractures and characterization by a formation micro-imager can be used to see differences between core permeabilities and well injectivity.

Production data may include, for example, FlowScan Imager (FSI), production logging tools (PLT) or well test data. The production data may be used to refine the reservoir description and the validity of zonal properties. Consistency between reservoir description and actual production data may be estimated from logs. The production data may also be used to ensure consistency between reservoir description and actual production data.

Data may be separately categorized and/or manipulated. For example, information about damage may be in the form of "damage nature", which may be useful in selecting proper fluids or additives to remove the damage. However, the quantification of the damage may be of secondary importance for portions 476-482 of the method (e.g., including target volume and rate distribution). Damage may or may not influence fluid placement, and optimal treatment may not be a prerequisite for a treatment that bypasses damage in all zones that may be stimulated.

In another example, in cases where deep damage is suspected or when low acid volumes are used, an objective of bypassing damage may be introduced in the objective function defining the optimum treatment. This may be done by defining a hypothetical depth of damage (e.g., global or per zone), or by introducing sensitivity in the objective function that favors deeper treatments. The local damage may be considered as a variable, which may influence the fluid distribution.

How the damage influences the placement may be applied to portions 484 and 486 of the method. For example, damage influences on placement may be applied during diverter selection and treatment execution, and/or where the role of the engineer is to select the correct diverter to counteract the natural injection profile and to remain close to an optimal injection profile.

Establishing objectives 478 involves establishing one or more objectives of the stimulation operation. The objectives may be established 478 within the constraints identified 480. Example objectives may include one or more of the following: maximum production rate after treatment, maximum fluid recovery of the reservoir, uniform placement of fluid across all zones, uniform injectivity after treatment (for injector wells), minimum injection pressure after treatment (for injector wells), reach given negative skin values in certain zones (while the fate of other zones may or may not be important), uniform removal of damage, elimination of a requirement to further stimulate the zone (i.e., reaching damage skin=0 in each zone), etc.

The objective function may be translated into mathematical terms in the engineering tool used in determining the distributions 482. For example, the objective function may be formed as any combination of the example objectives listed above, with various weights to allow the ranking of the priority of the objectives.

The objective function may be established 478 prior to selecting the operational parameters 484. Operational parameters, such as selection of diverters, may be used to achieve the established objective. The objective leads to determining target volume and rate distribution, and the operational parameters (e.g., materials/pumping schedules) are used to achieve this objective. The method 400 provides separation between the objective function in 478 and the operational parameters in 484. The method, therefore, decouples aspects of the stimulation operation 400 to consider each aspect individually.

Tasks, such as material selection, pumping schedule definition and objective optimization, may be performed simultaneously (e.g., by an engineer), without indication of whether the treatment being designed is optimal or not. Interaction between various aspects of the method may be present, such as relationships between injection rate and stimulation efficiency.

The method may be used in a manner that permits the consideration of each aspect individually and/or as a whole. This may also allow for the detection of various causes of outcomes. If a stimulation operation is predetermined not to be optimal, this may be due to wrong material selection, pumping parameters, or simply to the parameters of the well or reservoir. By decoupling the method, various aspects of the method may be examined alone or in combination in order to determine which generated the negative or positive impact.

Constraints (or boundaries) for determining the distributions 482 may be identified 480. Constraints may be of various natures, and may include, for example type of acid, horsepower, fracture gradient, wellhead maximum pressure, acid volume, operating pressures, costs, environmental objectives, client requirements, fluid availability, etc. A variety of acids may be used for stimulation operation, depending on performance under applicable conditions. For example, available horsepower may define pumping capacity, which may be limited by the application (e.g., offshore, coiled tubing rates, etc.).

Acid volume may be limited by, for example, the number of available fluid tanks, room on location, etc. Maximum BHP and/or wellhead pressure may be determined for a given stimulation operation. Cost limits may be set by the client, which may affect, for example, pump volume, price of additives, certain placement limitations, etc. Other considerations, such as concern about corrosion that may restrict the strength of acid that can be used, wishes from the clients who are keen on trying a technical solution over another based on their past experience or motivations from their organization (e.g., no particulate diverter on smart completions and internal control valve (ICV)), type of placement technique (e.g., coiled tubing versus bullheading), etc.

The identified constraints 480 may be applied in determining the distributions 482 using, for example, an engineering tool (e.g., WELLBOOK or other acid placement simulator). The determining distributions 482 may involve, for example, determining volume and rate distributions per zone for the stimulation fluid to be injected in each discretized flow unit along the wellbore.

FIGS. 5.1-5.3 show examples 500.1-500.3 of a wellbore 506 with two zones 588 and 590. FIG. 5.1 illustrates one flow unit per zone in a two-zone reservoir. FIG. 5.2 illustrates flow computation over the flow unit with one of the two zones isolated. FIG. 5.3 illustrates flow computation over the flow unit with the other zone isolated.

In the example 500.1 of FIG. 5.1, the discretization of the wellbore and formation along the well is made with a resolution of at least one flow unit per zone. Multiple flow units may be assigned to each zone to increase calculation accuracy. This may be done, for example, when the flow distribution within a given zone may not be uniform (e.g., due to gravity effects for instance). The simulator may receive pieces of information gathered in 476, 478 and 480 of FIG. 4.

The skin versus injected volume for various rates of placement and for the chosen fluids, independently, layer by layer may be computed. In the two-zone case of FIG. 5.2, the flow is first computed in the flow unit of zone 588 by isolating zone 590, and varying the injection parameters. Zone 588 may then be isolated and the process repeated over the flow unit of zone 590 as shown in FIG. 5.3. A number of simulations may be performed per flow unit.

In a given example, each simulation may include the injection of a large volume of stimulation fluid, within the volume constraints, at a rate $r_i$. For each flow unit l, the output is therefore a set of $z_r \times n_f$ curves of the local skin $s_{l,t,j}$ of the flow unit vs. volume for each t=1, $n_r$ injection rate and for each fluid I=1, $n_f$.

Once a set of curves has been determined for all flow units, an optimization routine may be used to determine which combination of volumes and rates leads to (or the closer to) the objective established at 478, within the constraints established at 480. This then defines an optimum treatment. This method may be used to predict how far each treatment outcome is from the selected objective(s) and whether the constraints are met. For example, if the objective is to ensure maximum post-treatment production, the routine may calculate production based on a given skin profile for the wellbore and the reservoir under consideration.

In another example, the routine may look at the simulation results, which may already include the production calculations as part of their output. This may be done using the simulator computing the injection in some cases (e.g., Design WELLBOOK: Acidizing). If the objective is uniform post-treatment skin of a certain value, then a simple routine may be devised to look at all the treatment combinations that have been simulated previously and that lead to this objective. This may be done without having to compute or recompute flow.

Figure 6:
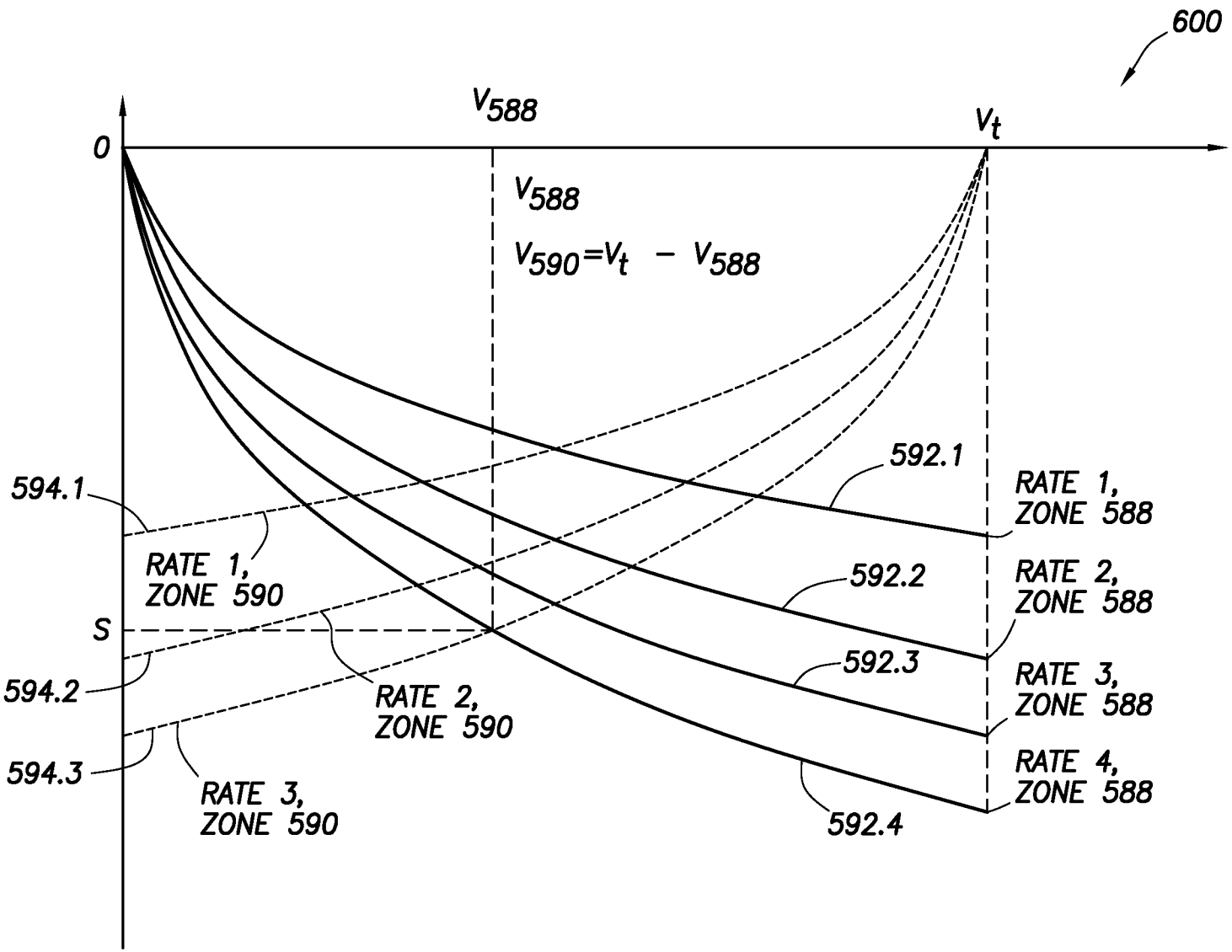
FIG. 6 is a graph depicting skin evolution as a function of flow rate and volume across zones during stimulation.

FIG. 6 is a graph 600 illustrating stimulation operation scenarios used in determining an optimum treatment. The graph 600 plots volume V (x-axis) in zone 588 and zone 590 of FIGS. 5.1-5.3 versus skin S (y-axis) for various flow rates 1-4. Lines 592.1-4 represent the skin evolution in zone 588 at rates 1-4, respectively. Lines 594.1-3 represent the skin evolution in zone 590 at rates 1-3, respectively.

This plot 600 depicts evolution of the skin as a function of the injected volume in each zone, for the rates 1-4. In this case, four rates were used for zone 588, with rate one being the lowest and rate four the highest. A total volume $V_t$ is a maximum volume possible along the x-axis. Volume $V_{588}$ is the volume in zone 588.

For zone 590, rates up to a value requiring a pressure larger than the fracturing pressure have been considered. This fracturing pressure limit provides a constraint 480 (FIG. 4). The optimum treatment can, thus, be identified in FIG. 6 as the case where a volume $V_{588}$ of acid is pumped at rate four in zone 588 and a volume $V_{590}$ ($=V_t-V_{588}$) is injected at rate three in zone 590. The total volume $V_t$ of acid available for the treatment may also be considered a constraint 480. This optimum treatment meets the objective of the lowest uniform post-treatment skin and the identified constraints.

As additional information is received, it may be represented in the diagram 700 of FIG. 7. This diagram 700 shows the wellbore 506 with the zones 588' and 590'. The zone 588' depicts the optimized volume and injection rate for zone 588 of FIGS. 5.1-5.3. The zone 590' depicts the optimized volume and injection rate for zone 590 of FIGS. 5.1-5.3.

Optimum placement may be determined from cases where simulations are run on single flow units, one by one, and independently. In other words, each simulation may not consider the distribution of flow across a well where several flow units are present. This also means that some consistency checks may need to be performed when combining all the results for defining the optimum treatment.

Confirmations may be performed to check that the outcomes are correct. For example, the sum of the injection volumes for each zone may be checked to confirm that it equals the total volume to be pumped if it is a constraint. In another example, for the two-zone scenario of FIGS. 5.1-5.3 and assuming that the total treatment volume was a constraint, the scenario given in FIG. 5 can be valid if the total volume to inject is 90 bbl. Such a consistency check task can be done by the optimization routine that has been described previously.

Referring back to FIG. 4, after distributions are determined 482, the fluid placement can be determined. Subsequent decisions regarding the placement strategy, diverter material selection may be made to get as close as possible to the optimum fluid distribution. This may be done without questioning the optimum fluid distribution itself, as determined in 482.

Operational parameters 484, such as material selection and treatment design, may next be selected. At this stage, diverters and pumping schedule parameters are selected. Diverter selection involves determining which diverter can give the ability to distribute the flow as determined 482. Method of placement may also be provided based on the diverter selection. Pumping schedule parameters, such as injection rate, number of stages of diverters, rate, volume of diverters to inject per stage, etc., are determined in order to obtain the flow distribution 482.

Diverters may be selected using diverter properties available from documentation or obtained from made-for-purpose laboratory tests. The material selection and pumping schedule design can be made using a placement simulator, such as the acid placement module in STIMCADE, or design WELLBOOK: Acidizing, or any placement simulator. At this stage, at least some variables may be sensitized. Damage variables, such as damage skin and damage penetration, may also be included. Damage variables may affect the flow distribution and the outcome of each diversion stage, but may not influence the optimum placement design determined 482, which may be independent of the characteristics of near wellbore damage.

In an operational example, an engineer or client may start the design of a stimulation operation with the wish that no mechanical isolation tool should be used in order to save cost. The engineer in charge of design can estimate how this wish may affect the outcome of the treatment and show without ambiguity how far the treatment with diverting slurries lays from the optimal fluid distribution. If not diverting slurry allows placing the fluid close to the optimum target, then the engineer may be able to make a clear call on where and how many bridge plugs may be placed for achieving a treatment that lays within an acceptable deviation from the optimal treatment.

The execution 486 may involve pumping treatment, monitoring fluid distribution parameters, and/or modifying treatment. The modifying may involve injecting diverters to overcome deviation from target as determined in determining distribution 482. During execution 486, the flow distribution of the fluid during the stimulation operation may be monitored to understand where the optimum fluid distribution deviates from the determined distribution 482. Appropriate decisions may be made to address those deviations. The execution 486 may be activated using, for example, the surface unit 121 and controller 126 of FIG. 1.

Methods to track the volume and rate of fluid injected along the well, such as Distributed Vibration Sensing (DVS) and Distributed Temperature Sensing (DTS), may be used. Real time monitoring may be performed using, for example, ACTIVE MATRIX. This may be used, for example, to monitor treatments that are done using coiled tubing as a conveyance and pumping method.

In some cases, it may be necessary to intervene to redirect flow in non-stimulated zones, for example, where the initial damage profile is likely to be different from the damage profile initially assumed. In some other cases, when the damage of one zone is removed, then the fluid tends to go preferentially to that zone, and action may be required to redistribute the fluid to the other target zones.

The stimulation tool 123 may be used to optimize the fluid volume and rate along the well. The stimulation tool may have a distribution component used to perform the distribution determination 482. This may involve computing the optimal volume and rates of placement, independently, layer by layer. The distribution component may also run a number of simulations per zone (or flow unit). Each simulation is the injection of a large volume of stimulation fluid at a given injection rate $r_n$. Once the set of curves has been estimated for all zones, an optimization routine then determines the optimum combination of volume and rate versus depth to minimize deviation from a chosen objective.

The stimulation tool 123 may also have a real-time measurement component to estimate fluid volume and rate along the wellbore. This may be used to take corrective action when deviating from the optimum placement determined at 482. Corrective action may be implemented by the controller 126 and/or surface unit 121.

The optimized volume placement can be designed considering an undamaged well (e.g., in carbonates, damage may be bypassed and, therefore, may not influence what the optimal fluid placement is). How damage influences fluid placement may be dealt with during the material selection 484 and execution 486. Fluid placement may be optimized based on known data, such as permeability logs and reservoir pressure that can be measured. Damage may be based on assumptions, but if it changes the injectivity profile while fluids are pumped, the treatment may be modified to stay close to the goal of placing the fluids optimally.

In an example operation implementing the method of FIG. 4, data is collected 476. The collected data in this example includes drainage radius, bottom hole static temperature (BHST), surface temperature and fluid surface temperature as set forth in Table 1 below. Other data, such as casing dimension, perforations and zone properties may also be considered.

TABLE 1

| Reservoir data | | |
|---|---|---|
| Data | Measurement | |
| Drainage Radius: | 1500.0 ft | 457.2 m |
| Bottom Hole Static Temperature (BHST): | 220 deg F. | 104.4 deg C. |
| Surface Temperature: | 80 deg F. | 26.7 deg C. |
| Fluid Surface Temperature: | 80 deg F. | 26.7 deg C. |

Wellsite parameters for this example may be known or determined. Some such parameters may include the number of zones, the zone dimensions, and permeability, injectivity (K·H—permeability×height), porosity, zone pressure, ratio of horizontal permeability ($K_h$) over vertical permeability ($K_v$), fracture gradient and other zone properties. Table 2 below shows (in English and SI units) examples of wellsite parameters (or zone properties) that may be considered:

TABLE 2

| Zone properties, to be stimulated Producing Zone Properties | | | | | | | | | |
|---|---|---|---|---|---|---|---|---|---|
| Zone Name | Top (MD) ft | Bottom (MD) ft | Interval (MD) ft | Permeability md | KH md · ft | Porosity % | Zone Pressure psi | $K_h/K_v$ | Frac Gradient psi/ft |
| K1 | 15322.0 | 15457.9 | 135.9 | 32.3 | 2487 | 19.0 | 5200 | 10.00 | 0.900 |
| K2 | 15850.0 | 15894.1 | 44.1 | 209.9 | 5042 | 20.0 | 5232 | 10.00 | 0.900 |
| K3 | 16802.0 | 16904.9 | 102.9 | 71.4 | 3999 | 21.0 | 5287 | 10.00 | 0.900 |
| Zone Name | Top (MD) m | Bottom (MD) m | Interval (MD) m | Permeability $m^2$ | $K \cdot H$ $m^2 \cdot m$ | Porosity % | Zone Pressure MPa | $K_h/K_v$ | Frac Gradient kPa/m |
| K1 | 4670.1 | 4711.6 | 41.5 | $32.3 \times 10^{-15}$ | $1340 \times 10^{-15}$ | 19.0 | 35.85 | 10.00 | 22.62 |
| K2 | 4831.1 | 4844.5 | 13.4 | $209.9 \times 10^{-15}$ | $2813 \times 10^{-15}$ | 20.0 | 36.07 | 10.00 | 22.62 |
| K3 | 5121.3 | 5152.6 | 31.3 | $71.4 \times 10^{-15}$ | $2235 \times 10^{-15}$ | 21.0 | 36.45 | 10.00 | 22.62 |

In this example, two different objectives are selected 478: 1) maximizing the production increase as measured at downhole conditions, and 2) minimizing a standard deviation of the final skins of the three zones (ie. the most uniform skin reduction). These objectives will be used to illustrate their impact on fluid placement.

Constraints are identified 480 as bottom-hole pressure during treatment, injection rate per zone, and total volume of acid. The constraint on bottom-hole pressure during treatment establishes that, at any time during the treatment, the bottom-hole pressure remains below fracturing pressure of the three zones. The constraint on injection rate per zone establishes that the maximum injection rate per zone does not exceed 80 bbl/min.

The constraint on the total volume of acid establishes that the total volume injected does not exceed a total volume $V_t$. For the sake of this example, three cases are considered to illustrate how the volume constraint may affect the optimum placement to reach the objectives define 478: Case 1) $V_t$=200 bbl, Case 2) $V_t$=500 bbl, and Case 3) $V_t$=800 bbl.

The target volume and rate distribution versus depth is determined 482. This volume and rate distribution is to be injected in each discretized flow unit along the wellbore. In this example, one flow unit per zone is used. HCl 28% is used as stimulation fluid. Simulations are run using the engine from Design WELLBOOK:

A routine has been coded so that for each of the three zones, a batch of simulations are run while isolating the zone from the other two (see, e.g., FIGS. 5.1-5.3). This isolation may be done while varying both injection rate (from 5 bbl/min to 80 bbl/min, with a step of 5 bbl/min) and injection volume. The injection volume may be represented by the "coverage", starting at 10 gal/ft (124.19 l/m) and up to whichever value would give a volume of 800 bbl of HCl 28% injected in the zone, with a coverage step of 10 gal/ft (124.19 l/m). A total of 2,144 simulations may be run to cover the example including the two objective functions established 478, and the different values of constraints identified 480.

The simulations may be run in three distinct batches (one for each zone, taken separately). This example provides 400 simulations for the top zone (zone K1), 1,216 simulations for the central zone (zone K2), and 528 simulations for the bottom zone (zone K3).

Once the simulation results are obtained, an optimization routine may be used to look for the combinations of rates and volumes for each zone that approach or meet the objective functions 478. This routine may be used to first eliminate combinations that do not meet the constraints identified 480. Then, from the resulting reduced matrix of results, the sum of the three volumes pumped in the three zones can be compared to the maximum total volume admissible. The combinations that exceed this maximum volume may be discarded.

The remaining combinations may be ranked with respect to how close to the objective functions they are. Note that in this example, the optimization work may be done after all the simulations have been run. An alternative approach may be to use an optimization algorithm that modifies the fitting parameters (in this case, rate and volume for each zone) used as input of the forward simulations themselves (therefore, mixing optimization and simulation) in order to tend to the objective.

The operational parameters may be selected 484, for example, by comparing various outputs based on the selected objectives. Selected outputs may be plotted and analyzed as shown in FIGS. 8.1-8.3. FIGS. 8.1-8.3 show plots 800.1-800.3 depicting volume injected (x-axis) for each zone (y-axis) for three different total injection volumes. Objective 1 for maximum production rate and objective 2 for minimum standard deviation of skin are each depicted in bar charts for comparison.

These plots of FIGS. 8.1-8.3 may be used to compare differences in how objective functions can affect the target fluid placement, and how the values of the constraints influence placement strategy. As shown in these figures, differences in volume distribution are depicted. While FIGS. 8.1-8.3 depict specific parameters used for comparison, other placement options may be generated by the simulators and can include other items, such as both volumes and placement rates. This information may be of value in designing the stimulation of the multi-zone well.

The plots of FIGS. 8.1-8.3 may be analyzed to determine optimum placement for different objective functions. These figures show the volumes per zone to inject in order to meet the different objective functions for the cases when the total volume is constrained to 200 bbl, 500 bbl and 800 bbl, respectively.

While for 200 bbl in FIG. 8.1, the volume distribution is the same for the two objectives, FIGS. 8.2 and 8.3 show that the fluid placement may be significantly different depending on whether the objective is to maximize production or to reach uniform placement in the cases when 500 and 800 bbl will be injected. This highlights that achieving a uniform skin profile in all zones may not be a universal approach, and that maximizing production rate may require a fluid distribution that differs from uniform coverage.

Based on FIG. 8.1, a perfect match between the two objectives is provided. This may be the result of volume steps used in the iterations. While fluid volume distribution is identical for the two objectives, the placement rate in each zone may be different. The final production rate of the case when the uniform placement is met may be higher than that for the case when the production is maximized.

Optimum placement may also be provided for different volume constraints. FIGS. 9.1 and 9.2 are graphs 900.1 and 900.2 depicting treatment along the three zones in view of a desired objective for comparison. These figures plot fracture of treatment volume per zone (x-axis) versus three zones (y-axis). The fluid distribution is expressed in percent of total volume in order to achieve the objectives of maximizing production 900.1 and minimize the standard deviation of skin 900.2, for the cases 1, 2 and 3 having a volume $V_t$ of 200, 500, and 800 bbl, respectively.

As shown in FIG. 9.1, the relative profile of injected fluid differs for different total volumes to inject. FIG. 9.2 also indicates that the relative profile of injected fluid differs for different total volumes to inject. Uniform fluid coverage (i.e., injection of the same amount of fluid in each zone) does not meet any objective function considered in this example. In some cases, attempting to inject the same amount of fluid in zones of different injectivities may or may not be a good approach to maximize production or to obtain uniform stimulation across those zones.

In some cases, uniform placement of acid may be implemented. As shown in FIGS. 8.1-9.3, objectives may be considered that may suggest non-uniform placement of acid in order to optimize production.

FIGS. 10.1 and 10.2 depict an example where the objective function relates to the well's production rate for a given total volume constraint for the treatment. FIG. 10.1 may be used as a reference for determining operational parameters 484 (e.g., selecting his materials and designing the pumping schedule) and executing the treatment 486 (FIG. 4). FIG. 10.1 is a schematic diagram depicting a wellbore 1004 with three zones 1088.1, 1090.1 and 1091.1. In FIG. 10.1, the objective function is to maximize the well's production rate and the total volume constraint for the treatment of 200 bbl. Each zone is depicted as having a different optimal volume, but the same optimal injection rate for the placement of 200 bbl of HCl 28% to maximize production.

In an example where total volume constraint for the treatment is 500 bbl, and that the objective function is to minimize standard deviation of the skin. FIG. 10.2 may also be used as a reference for determining operational parameters 484 (e.g., selecting his materials and designing the pumping schedule) and executing the treatment 486 (FIG.

4). FIG. 10.2 is a schematic diagram depicting a wellbore 1004 with three zones 1088.2, 1090.2 and 1091.2. Each zone is depicted as having a different optimal volume and different optimal injection rate for the placement of 500 bbl of HCl 28% to minimize skin standard deviation.

Operational parameters, such as selection of materials and design of the fluid injection schedule, may be determined 484 with the goal being to get as close as possible to the fluid distribution and rate distribution determined 482 (FIG. 4). Tools, such as Design WELLBOOK: Acidizing may be used in determining the operational parameters. Design WELLBOOK: Acidizing may be used to simulate the effects of diverters on fluid placement and to monitor the fluid rate in each zone during the treatment. The design (e.g., pumping schedule, material selection, etc.) may be changed in order to get the fluid distribution to match the determined distributions 482.

Execution 486 may involve real-time monitoring using, for example, sensors 125 at the wellsite (see, e.g., FIG. 1). The real time monitoring may be used to align the optimum placement 482 with the actual results. The sensors may include various gauges along or at the bottom of the serviced wells, DTS measurements, and/or coiled tubing units that can provide real time information. Monitoring volume and rate of placement during treatment may be performed using, for example, ACTIVE™. Gathered information may be combined to provide an understanding of what happens during the treatment.

DTS measurements may be used to give a continuous temperature profile along the wellbore and to provide the temperature evolution during injection and shut-in periods. This evolution, which may be linked to the local differences in the amount of fluid injected along the wellbore, may yield some indications about the fluid placement performance or zonal coverage. Interpretation of such DTS traces may be qualitative, with at least some attention paid to the rate of warmback (or cooldown) that may indicate thief zones or intervals to be stimulated. DTS measurements may be used to couple an inversion algorithm and a forward model of fluid injection into a reservoir in order to quantify the intake profile of treatment fluid along the wellbore.

Skin evaluation, such as damage characterization or skin by layer, during the design and the execution of the treatment is not required, but may optionally be considered. Skin evaluation may be determined where the acid must be injected, at which rate and volume, to meet the objective function. This determination can be done considering an undamaged well, and relying on formation properties that can be measured with sufficient accuracy. How damage influences fluid placement may be dealt with during the execution without relying on indirect parameters such as skin or local skin. Corrective actions may be taken to ensure that the optimal volume of stimulating fluid goes in the target layer(s) at the optimal rate determined 482.

Figure 11:
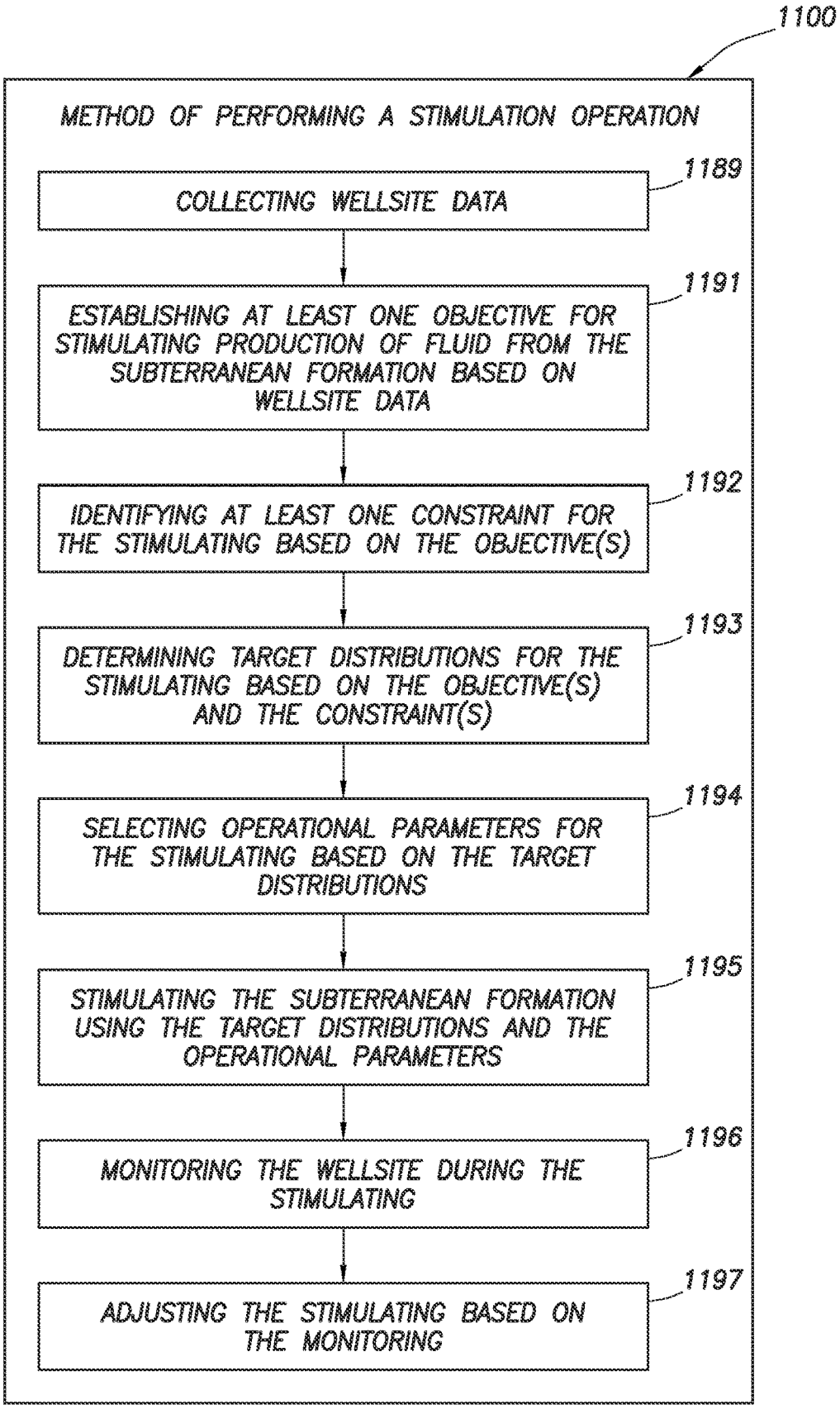
FIG. 11 is a method of stimulating a wellbore using an "optimized" configuration.

FIG. 11 depicts an alternate method 1100 of stimulating a wellsite. In this version, the stimulating involves collecting wellsite data 1189, establishing 1191 at least one objective for stimulating production of fluid from the subterranean formation based on wellsite data, identifying 1192 at least one constraint for the stimulating based on the objective(s), determining 1193 target distributions for the stimulating based on the objective(s) and the constraint(s), selecting 1194 operational parameters for the stimulating based on the target distributions, stimulating 1195 the subterranean formation using the target distributions and the operational parameters, monitoring 1196 the wellsite during the stimulating, and adjusting 1197 the stimulating based on the monitoring.

The methods herein may be performed in any order and repeated as desired. Portions of the methods may be used in other methods as desired.

The statements made herein merely provide information related to the present disclosure and may not constitute prior art, and may describe some embodiments illustrating the invention. All references cited herein are incorporated by reference into the current application in their entirety.

Although only a few example embodiments have been described in detail above, those skilled in the art will readily appreciate that many modifications are possible in the example embodiments without materially departing from the system and method for performing wellbore stimulation operations. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method of performing a stimulation operation at a wellsite, the wellsite positioned about a subterranean formation having a wellbore therethrough and zones therealong, the method comprising:

establishing at least one objective for stimulating production of reservoir fluid from the subterranean formation and into the wellbore, wherein the at least one objective is based on wellsite data, and wherein the at least one objective comprises optimizing one or more skin parameters;

identifying at least one constraint for the stimulating;

determining target distributions of stimulating fluid based on the at least one objective and the at least one constraint;

selecting operational parameters for the stimulating based on the at least one constraint and the target distributions;

performing the stimulation operation in the wellbore by placing a stimulating fluid along the zones, wherein the stimulation operation comprises performing a matrix stimulation treatment, wherein performing the stimulation operation comprises determining an apparent skin effect in real time;

monitoring the wellsite while performing the stimulation operation, wherein monitoring the wellsite comprises evaluating an efficiency of the matrix stimulation treatment; and adjusting the stimulating fluid based on the monitoring, wherein the stimulating comprises matrix acidizing.

2. The method of claim 1, wherein the at least one objective comprises comprise maximizing production rate, maximizing fluid recovery, uniform placement of fluid across all zones, and combinations thereof.

3. The method of claim 1, wherein the operational parameters comprise diverter type, diverter placement, pump schedule parameters and combinations thereof.

4. The method of claim 1, further comprising collecting wellsite data.

5. The method of claim 4, wherein the wellsite data comprises at least one of drainage radius, bottom hole static temperature, surface temperature, fluid surface temperature, reservoir, casing dimension, perforation dimensions, and zone properties.

6. The method of claim 1, further comprising stimulating the subterranean formation using the target distributions and the operational parameters.

7. The method of claim 1, wherein the target distributions comprise target volume, flow rate distribution, and combinations thereof.

8. The method of claim 1, wherein the one or more skin parameters comprise skin effect, permeability due to skin damage, target skin distribution, and combinations thereof.

9. The method of claim 1, comprising determining the one or more skin parameters based on damage penetration using a logging tool.

10. The method of claim 1, comprising performing a step rate test and determining an initial skin effect before performing the stimulation operation.

11. The method of claim 1, wherein monitoring the wellsite comprises determining whether a positive or negative skin effect is present.

12. The method of claim 1, comprising:

determining an apparent skin effect in real time; and performing a step rate test and determining an initial skin effect before stimulating the subterranean formation.

13. The method of claim 1, wherein the at least one constraint is selected from the group consisting of horsepower, fracture gradient, acid volume, environmental objectives, fluid availability and combinations thereof.

14. A method of performing a matrix acidizing operation at a wellsite, the wellsite positioned about a subterranean formation having a wellbore therethrough and zones therealong, the method comprising:

collecting wellsite data;

analyzing the wellsite data to determine one or more skin parameters based on damage penetration using a logging tool;

establishing at least one objective for stimulating production of reservoir fluid from the subterranean formation and into the wellbore, wherein the at least one objective is based on wellsite data, and wherein the at least one objective comprises optimizing the one or more skin parameters;

identifying at least one constraint for the stimulating;

determining target distributions of stimulating fluid based on the at least one objective and the at least one constraint, wherein the target distributions comprise a target skin distribution;

selecting operational parameters for the stimulating based on the at least one constraint and the target distributions; and stimulating the subterranean formation by placing a matrix acidizing fluid along the zones based on the target distributions and the operational parameters.

15. The method of claim 14, wherein the stimulating comprises executing one of pumping treatment fluid, injecting diverters, applying acid and combinations thereof.

16. The method of claim 14, wherein the at least one constraint is selected from the group consisting of horsepower, fracture gradient, acid volume, environmental objectives, fluid availability and combinations thereof.

17. A method of performing a matrix acidizing operation at a wellsite, the wellsite positioned about a subterranean formation having a wellbore therethrough and zones therealong, the method comprising:

establishing at least one objective for stimulating production of reservoir fluid from the subterranean formation and into the wellbore, wherein the at least one objective is based on wellsite data, and wherein the at least one objective comprises optimizing one or more skin parameters;

identifying at least one constraint for the stimulating;

determining target distributions of stimulating fluid based on the at least one objective and the at least one constraint, wherein the target distributions comprise a target skin distribution;

selecting operational parameters for the stimulating based on the at least one constraint and the target distributions;

stimulating the subterranean formation by placing a matrix acidizing fluid along the zones using the target distributions and the operational parameters;

monitoring the wellsite during the stimulating, wherein monitoring the wellsite comprises determining whether a positive or negative skin effect is present; and adjusting the stimulating based on the monitoring.

18. The method of claim 17, wherein the monitoring comprises sensing wellsite parameters.

19. The method of claim 17, wherein the adjusting comprises modifying injection, injecting diverters and combinations thereof.

20. The method of claim 17, wherein adjusting comprises selectively providing placement of the matrix acidizing fluid based on information received during monitoring.

21. The method of claim 17, wherein monitoring comprises real-time monitoring and wherein adjusting comprises modifying the original treatment design to target zones that show poor injectivity.

22. The method of claim 17, wherein adjusting comprises injecting diverters to overcome deviation from target as determined in determining the target distributions.

23. The method of claim 17, wherein the at least one constraint is selected from the group consisting of horsepower, fracture gradient, acid volume, environmental objectives, fluid availability and combinations thereof.

* * * * *